US010665407B2

(12) United States Patent
Gutmann et al.

(10) Patent No.: US 10,665,407 B2
(45) Date of Patent: May 26, 2020

(54) SPRING MEMBER FOR AN ELECTRIC SWITCHING DEVICE SUCH AS A CRADLE RELAY

(71) Applicant: Tyco Electronics Austria GmbH, Vienna (AT)

(72) Inventors: Markus Gutmann, Brand (AT); Rudolf Mikl, Maria Ellend (AT); Paul Indrajit, Markdorf (DE)

(73) Assignee: Tyco Electronics Austria GmbH, Vienna (AT)

( * ) Notice: Subject to any disclaimer, the term of this patent is extended or adjusted under 35 U.S.C. 154(b) by 344 days.

(21) Appl. No.: 15/661,812

(22) Filed: Jul. 27, 2017

(65) Prior Publication Data

US 2017/0323750 A1 Nov. 9, 2017

Related U.S. Application Data

(63) Continuation of application No. PCT/EP2016/052005, filed on Jan. 29, 2016.

(30) Foreign Application Priority Data

Jan. 30, 2015 (EP) ..... 15153202

(51) Int. Cl.

| | |
|---|---|
| ***H01H 50/56*** | (2006.01) |
| ***H01H 50/58*** | (2006.01) |
| ***H01H 50/64*** | (2006.01) |
| *H01H 3/48* | (2006.01) |

(52) U.S. Cl.

CPC ..... *H01H 50/58* (2013.01); *H01H 50/56* (2013.01); *H01H 50/641* (2013.01); *H01H 3/48* (2013.01); *H01H 50/642* (2013.01); *H01H 2205/002* (2013.01)

(58) Field of Classification Search

CPC ..... H01H 50/56; H01H 50/58; H01H 50/642

See application file for complete search history.

(56) References Cited

U.S. PATENT DOCUMENTS

| | | | | |
|---|---|---|---|---|
| 5,392,015 | A | 2/1995 | Matsuoka et al. | |
| 5,719,541 | A * | 2/1998 | Mader | H01H 50/642 335/78 |
| 8,816,800 | B2 | 8/2014 | Mikl | |

FOREIGN PATENT DOCUMENTS

| | | | |
|---|---|---|---|
| CN | 102568937 | A | 7/2012 |
| DE | 3147563 | A1 | 10/1982 |
| EP | 1420428 | A1 | 5/2004 |
| JP | S63-175312 | A | 7/1988 |

(Continued)

OTHER PUBLICATIONS

Japanese Notice of Reasons for Refusal and English Translation, Japanese Patent Application No. 2017-538975, dated Mar. 5, 2019, 14 pages.

(Continued)

*Primary Examiner* — Ramon M Barrera
(74) *Attorney, Agent, or Firm* — Barley Snyder

(57) ABSTRACT

A spring for an electric switch comprises a base portion, a contact section, and a return spring section. The base portion forms a proximal end of the spring. The contact section extends from the base portion to a distal end of the spring opposite the proximal end. The contact section has a contact member. The return spring section extends from the base portion alongside the contact section.

18 Claims, 4 Drawing Sheets

(56) References Cited

FOREIGN PATENT DOCUMENTS

| | | | |
|---|---|---|---|
| JP | H05325760 | A | 12/1993 |
| JP | 2000285783 | A | 10/2000 |
| WO | 2014207018 | A1 | 12/2014 |

OTHER PUBLICATIONS

Chinese First Office Action and English translation, dated Jul. 3, 2018, 23 pages.
Japanese Notice of Reasons for Refusal, and English translation, dated Jun. 19, 2018, 9 pages.
English machine translation of JPH05325760, Dec. 10, 1993, 12 pages.
English machine translation of JP2000285783, dated Oct. 13, 2000, 11 pages.
Abstract of DE3147563A1, dated Oct. 7, 1982, 1 page.
European Search Report, dated Aug. 7, 2015, 6 pages.
PCT Notification, International Search Report and Written Opinion, dated Mar. 31, 2016, 13 pages.
Chinese Third Office Action with English translation, Chinese Patent Application No. 201680007486.9, dated Sep. 16, 22 pages.

* cited by examiner

SPRING MEMBER FOR AN ELECTRIC SWITCHING DEVICE SUCH AS A CRADLE RELAY

CROSS-REFERENCE TO RELATED APPLICATIONS

This application is a continuation of PCT International Application No. PCT/EP2016/052005, filed on Jan. 29, 2016, which claims priority under 35 U.S.C. § 119 to European Patent Application No. 15153202.5, filed on Jan. 30, 2015.

FIELD OF THE INVENTION

The present invention relates to a spring and, more particularly, to a spring for an electric switch such as a cradle relay.

BACKGROUND

Known springs used in electric switches such as cradle relays have a distal end, a proximal end opposite the distal end, a base portion at the proximal end, and a contact section. The contact section extends from the base portion to the distal end and has a contact member at which the contact section contacts a counter contact to open or close electrical contact with the counter contact.

In known switching relays, a drive system comprising a coil, a yoke, and an armature generates a driving force to move the spring to close the electrical contact. The armature is driven when a control current is applied to the coil and the movement of the armature is imparted to the spring. A drive transmission member is disposed between the armature and the spring in order to transmit the armature's movement to the spring; in a cradle relay, the drive transmission member is formed by the cradle. The spring acts immediately upon the armature in order to return it to its original position when the drive system is shut off and the driving force is no longer generated. This design, however, makes known switching relays bulky and expensive to manufacture.

SUMMARY

A spring for an electric switch according to the invention comprises a base portion, a contact section, and a return spring section. The base portion forms a proximal end of the spring. The contact section extends from the base portion to a distal end of the spring opposite the proximal end. The contact section has a contact member. The return spring section extends from the base portion alongside the contact section.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
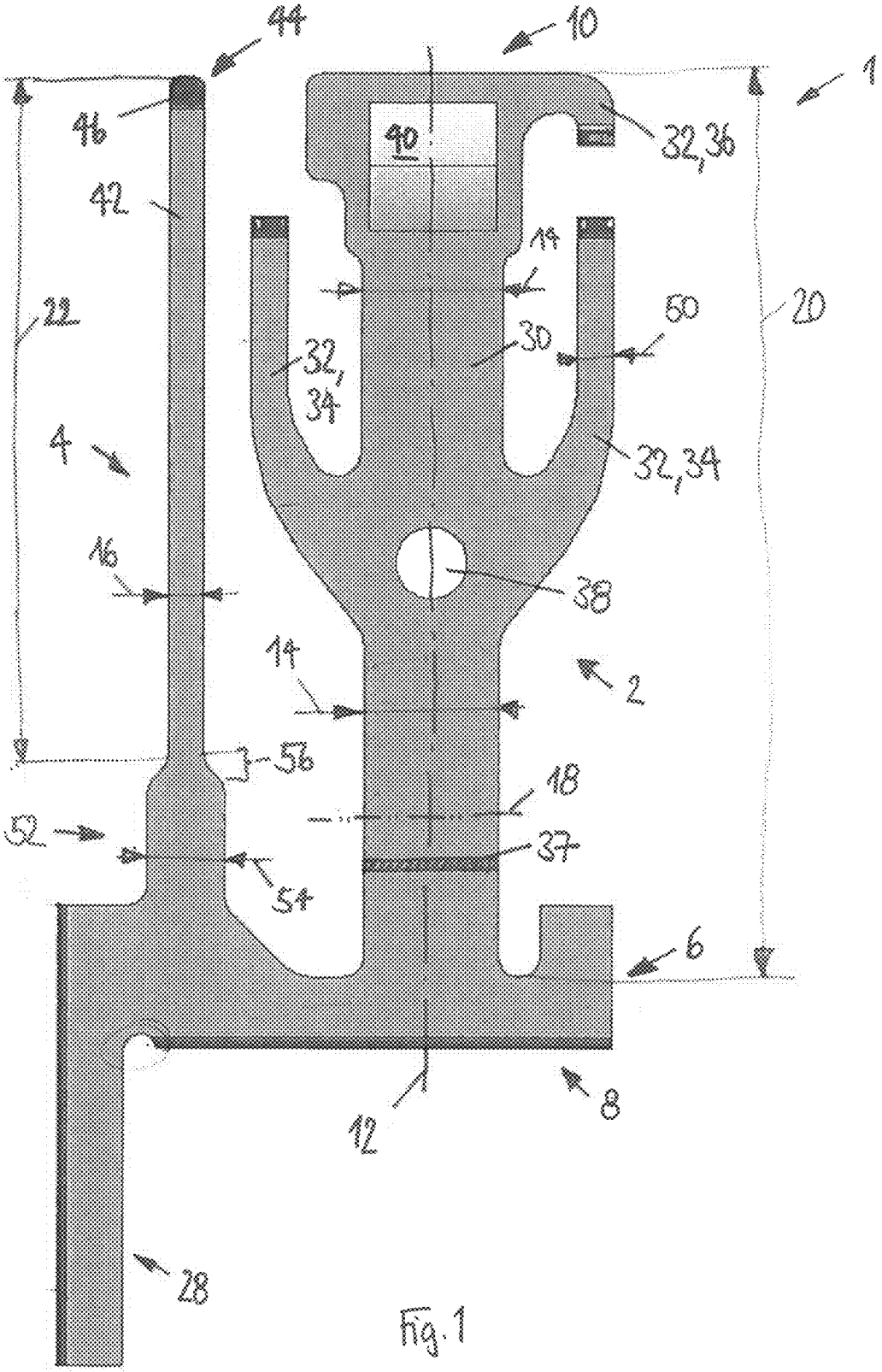
FIG. 1 is a front view of a spring according to the invention.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the present disclosure will be thorough and complete, and will fully convey the concept of the disclosure to those skilled in the art.

Figure 2:
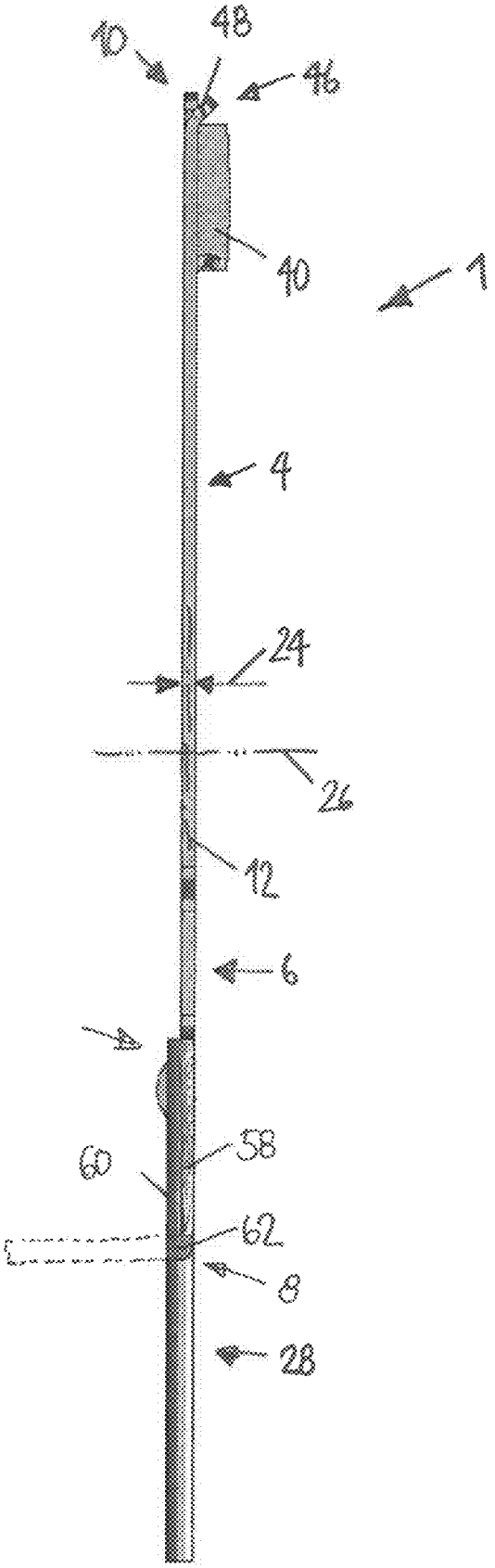
FIG. 2 is a side view of the spring.

A spring 1 according to the invention is shown in FIGS. 1 and 2.

The spring 1 has a contact section 2 and a return spring section 4 extending from a base portion 6. The base portion 6, as shown in FIG. 1, forms a proximal end 8 of the spring 1 and the contact section 2 extends from the base portion 6 to a distal end 10 of the spring 1. The return spring section 4 extends alongside the contact section 2. In the shown embodiment, both the contact section 2 and the return spring section 4 extend parallel to a lengthwise direction 12 extending from the proximal end 8 to the distal end 10. Both the contact section 2 and the return spring section 4 are elongated in the lengthwise direction 12. Their respective widths 14, 16 in a width direction 18, as shown in FIG. 1, are smaller than their respective lengths 20, 22 in the lengthwise direction 12. The width direction 18 extends perpendicular to the lengthwise direction 12.

In the embodiment shown in FIGS. 1 and 2, the spring 1 is formed monolithically from sheet metal, such as copper or a copper alloy, by punching and/or bending. As shown in FIG. 2, a material thickness 24 of the spring 1 in a thickness direction 26 is constant. The thickness direction 26 extends perpendicular to the lengthwise direction 12 and the width direction 18.

The spring 1, as shown in FIGS. 1 and 2, has a terminal section 28 extending away from the base portion 6 in a direction opposite the distal end 10. In the shown embodiment, the terminal section 28 extends parallel to the lengthwise direction 12; the terminal section 28 may alternatively extend in a direction perpendicular to the lengthwise direction 12.

The contact section 2, as shown in FIG. 1, has a main body 30 from which one or more spring arms 32 may branch off. In other embodiments, if no spring arms 32 are provided, the main body 30 itself may form a spring arm. In the embodiment shown in FIG. 1, an exemplary total of three spring arms 32 are shown. The contact section 2 may have at least one lower spring arm 34 and at least one upper spring arm 36. In the embodiment shown in FIG. 1, the contact section 2 has a pair of lower spring arms 34 and a single upper spring arm 36. In alternative embodiments, the spring 1 may have both a pair of lower spring arms 34 and a pair of upper spring arms 36, or a single lower spring arm 34 and a pair of upper spring arms 36, or a single lower spring arm 34 and a single upper spring arm 36.

In high current applications, the plurality of spring arms 32 ensure both that a cross-sectional area 37 of the contact section 2 is large enough to reduce electric resistance and that the stiffness of the contact section 2 is small enough to allow elastic deflection and proper adjustment of the elastic forces generated by a deflection of the spring arms 32. An opening 38 is disposed at a location where one or more spring arms 32 branch off from the main body 30.

The contact section 2, as shown in FIGS. 1 and 2, has a contact member 40. At the contact member 40, the contact section 2 establishes contact with a counter contact (not shown) of an electric switch. By being moved towards the counter contact, the spring 1 closes a circuit, and by being moved away from the counter contact, the circuit is interrupted. The contact member 40 is located at or close to the distal end 10 for easier deflection; the contact member 40 is closer to the distal end 10 than to the base portion 6. The contact member 40 is disposed between the lower spring arm 34 and the upper spring arm 36.

The return spring section 4, in the embodiment shown in FIGS. 1 and 2, has a single leg 42 of at least approximately constant width and approximately constant thickness. At a free end 44 of the return spring section 4, an inclined portion 46 is formed by bending a part 48 in the thickness direction 26, to the side where the contact member 40 is situated on the contact section 2. The return spring section 4 extends in the lengthwise direction 12 beyond the location of the contact member 40 and/or at least beyond the lower spring arms 34. In an embodiment, the return spring section 4 extends beyond all the spring arms 32.

A return spring stiffness of the return spring section 4 is less than a contact spring stiffness of the contact section 2. If the contact section 2 comprises spring arms 32, the return spring stiffness of the return spring section 4 is lower than the combined stiffnesses of all spring arms 32. In an embodiment, the return spring stiffness of the return spring section 4 is lower than the combined stiffnesses of two spring arms 32 and approximately equal to the stiffness of a single spring arm 32.

The width 16 of the return spring section 4, as shown in FIGS. 1 and 2, is smaller than the width 14 of the main body 30 of the contact section 2. The width 16 of the return spring section 4 is approximately equal to a width 50 of a spring arm 32 in the shown embodiment.

Between the return spring section 4 and the base portion 6, the spring 1 has a foot section 52 as shown in FIGS. 1 and 2. The foot section 52 has a stiffness greater than the stiffness of the return spring section 4. The foot section 52 has an increased stiffness due to a width 54 which is increased relative to the width 16 of the return spring section 4. In a portion 56 of the foot section 52, the width 54 of the foot section 52 decreases towards the return spring section 4.

The return spring section 4, although being connected to the contact section 2 monolithically by the base portion 6, is uncoupled with respect to deflections of the contact section 2. This is accomplished by making the base portion 6 much stiffer than both the contact section 2 and the return spring section 4.

The base portion 6, as shown in FIGS. 1 and 2, has a main portion 58 and at least one flap 60. The main portion 58 is substantially flush and co-planar with both the contact section 2 and the return spring section 4. The flap 60 is plastically deflected out of the plane of the main portion 58, to increase the stiffness of the base portion 6. The flap 60 is connected to the main portion 58 by a bent portion 62.

The flap 60, as shown in FIG. 2, lies in a plane which is parallel to the main portion 58. The bent portion 62 is bent 180° and the flap 60 abuts the main portion 58. In an alternative embodiment, as shown by dotted lines in FIG. 2, the flap 60 may extend at an angle of 90° to the main portion 58. At or close to an end of the base portion 6 opposite the proximal end 8, the flap 60 is attached to the main portion 58 by welding, a positive lock, or riveting.

The flap 60 increases stiffness of the base portion 6 and also increases the cross-sectional area 37 of the base portion 6 so that its electric resistance with respect to high currents is decreased. Furthermore, bending the flap 60 away from the main portion 58 decreases the overall height of the spring 1 in the lengthwise direction 12 between the proximal end 8 and a distal end 10, i.e. in that part that is contained in an electric switch.

Figure 3:
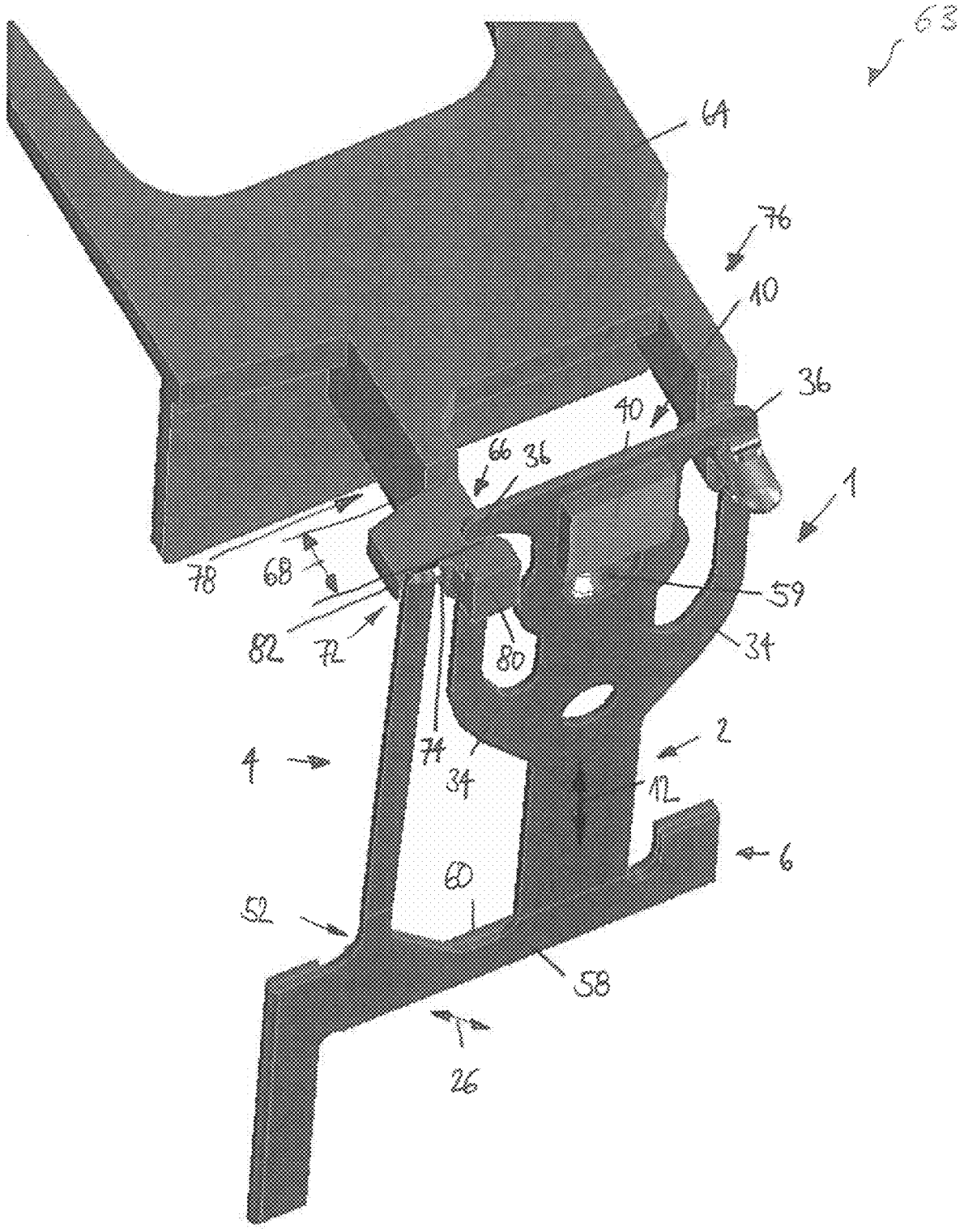
FIG. 3 is a perspective view of an assembly according to the invention comprising the spring.

An assembly 63 comprising the spring 1 and a drive transmission member 64 is shown in FIG. 3. In the embodiment shown in FIG. 3, the contact section 2 of the spring 1 has a pair of upper spring arms 36 and a bead 59 disposed between the contact member 40 and the base portion 6; the bead 59 is disposed between the lower spring arms 34 and the upper spring arms 36.

The drive transmission member 64 is formed from an electrically insulating material, such as a plastic, by injection-molding. The drive transmission member 64, as shown in FIG. 3, has a first support section 66 engaged with one upper spring arm 36 of the contact section 2. The first support section 66 is located in the lengthwise direction 12 approximately at the height of the contact member 40, close to the distal end 10. More generally, the first support section 66 is located between the lower spring arms 34 and the upper spring arms 36; in order to make the best use of the deflectability of the contact section 2, the first support section 66 is located close to the distal end 10.

At the first support section 66, the contact spring 2 is movable perpendicular to the lengthwise direction 12 in the thickness direction 26, to allow for a range of motion 68 in this direction. The range of motion 68 is limited by two stops 70 formed by the drive transmission member 64.

The drive transmission member 64, as shown in FIG. 3, has a second support section 72 against which the return spring section 4 rests. The second support section 72 consists of a support surface 74 which faces the return spring section 4 approximately at the height of the contact member 40 in the lengthwise direction 12, close to the inclined portion 46. At the support surface 74, the return spring section 4 is held only by friction and the otherwise free to slide along the support surface 74 or lift off the same. The drive transmission member 64 has, at its end 76 facing the spring 1, a protrusion 78 protruding towards the spring 1. In the shown embodiment, the first support section 66 and the second support section 72 are both located at the protrusion 78.

The first support section 66, as shown in FIG. 3, has a hook 80 which forms one or two of the stops 70. A shoulder 82 is formed by the hook 80 or the protrusion 78 respectively. The support surface 74 is located on this shoulder 82. The support surface 74 and one of the stops 70, in particular the stop 70 closer to the end of the end of the protrusion 78, are aligned to each other and lie within the same plane.

Figure 4:
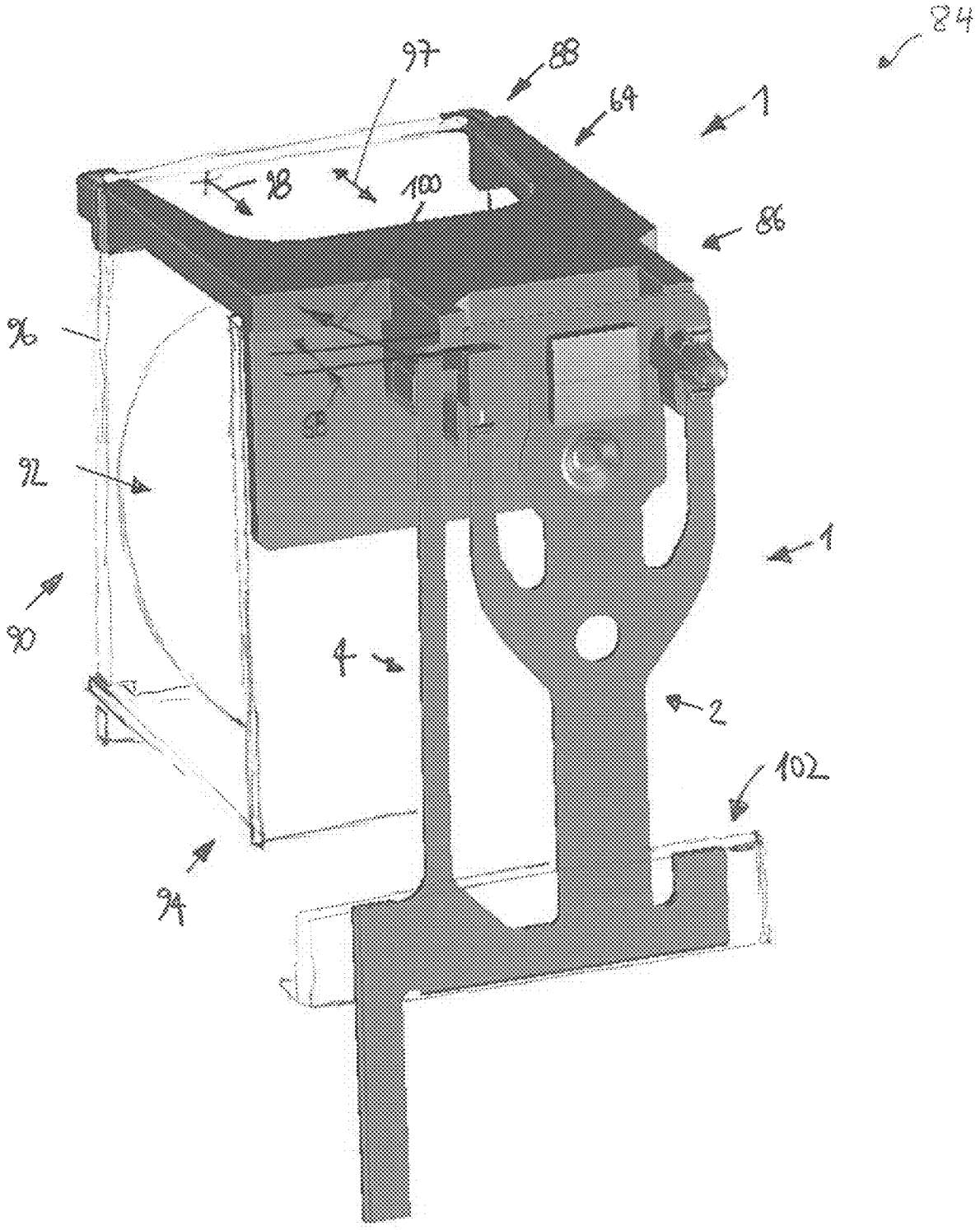
FIG. 4 is a perspective view of an electric switch according to the invention comprising the spring.

An electric switch 84 comprising the spring 1, the drive transmission member 64, and a drive system 90 is shown in FIG. 4. In the shown embodiment, the electric switch 84 is a cradle relay. The drive system 90 is a magnetic drive system comprising a coil 92, a yoke 94, and an armature 96.

As shown in FIG. 4, the drive transmission member 64 is coupled at one end 86 to the spring 1 and at its other end 88 to a drive system 90. The drive transmission member 64 is held slidable in a direction 97 extending from one end 86 to the other end 88 in the electric switch 84. The base portion 6 of the spring 1 is mounted fixedly in the electric switch 84.

In an initial state in which the drive system 90 is activated, the armature 96 is pulled towards the coil 92. The drive transmission member 64 is pushed by the armature 96 towards the spring 1, deflecting both the return spring section 2, and, after the range of motion 68 is exhausted, the contact section 2. By this motion, the contact section 2 is pressed against a fixed counter contact (not shown). The drive transmission member 64 is moved past a position at which the contact member 40 is in contact with the counter contact so that the spring arms 32 are deflected and resiliently press the contact member 40 against the counter contact. The driving force 98 exerted by the drive system 90 is counteracted by at least the return force 100 exerted by the deflected return spring section 4 and also by the deflection of the spring arms 32.

When the armature 96 is released by deactivation of the drive system 90, both the return spring section 4 and the contact section 2 initially move the armature 96 away from the coil 92. The return spring section 4 continues to move the armature 96 away from the coil 92 after the spring arms 32 of the contact section 2 relax because the range of motion 68 has been exhausted. As the contact section 2 and the return spring section 4 are de-coupled from each other by the stiff base portion 6, and in addition by the rigid fixation 102 of the base portion 6 along its length in the electric switch 84, the return force 100 is independent of the deflection of the contact section 2 which occurs during operation of the electric switch 84. Thus, an additional return spring section 4 acting directly on the armature 96 can be omitted.

Advantageously, in the spring 1 according to the invention, because the spring 1 has a return spring section 4 extending from the base portion 6 alongside the contact section 2, a force generated by the return spring section 4 acts closely to the contact member 40 and need not be transmitted by the drive transmission member 64 to the contact member 40. By integrating the return spring section 4 into the spring 1, fewer parts are necessary and the electric switch 84 may be reduced in size.

What is claimed is:

1. A spring for an electric switch, comprising:

a base portion forming a proximal end of the spring, the base portion has a main portion and a flap connected to the main portion by a bent portion, the bent portion is bent 180° and the flap abuts the main portion;

a contact section extending from the base portion to a distal end of the spring opposite the proximal end and having a contact member; and a return spring section extending from the base portion alongside the contact section.

2. The spring of claim 1, wherein the return spring section has a return spring stiffness less than a contact spring stiffness of the contact section.

3. The spring of claim 1, wherein the contact section is wider than the return spring section in a width direction perpendicular to a lengthwise direction of the spring, the lengthwise direction extending between the distal end and the proximal end.

4. The spring of claim 3, wherein the return spring section extends at least to the contact member in the lengthwise direction.

5. The spring of claim 1, wherein the return spring section has an inclined portion at the distal end.

6. The spring of claim 1, further comprising a foot section disposed between the return spring section and the base portion.

7. The spring of claim 6, wherein the foot section has a stiffness greater than a return spring stiffness of the return spring section.

8. The spring of claim 7, wherein the foot section has a width in a width direction perpendicular to a lengthwise direction of the spring decreasing in the lengthwise direction toward the return spring section.

9. An assembly for an electric switch, comprising:

a spring having a base portion forming a proximal end of the spring, a contact section extending from the base portion to a distal end of the spring opposite the proximal end, the contact section having a contact member, and a return spring section extending from the base portion alongside the contact section, the base portion has a main portion and a flap connected to the main portion by a bent portion, the bent portion is bent 180° and the flap abuts the main portion; and a drive transmission member having a first support section and a second support section, the first support section engaged with the contact section and the return spring section resting against the second support section.

10. The assembly of claim 9, wherein the drive transmission member has a protrusion extending toward the spring.

11. The assembly of claim 10, wherein the first support section and the second support section are disposed on the protrusion.

12. The assembly of claim 9, wherein the first support section is located adjacent the second support section.

13. The assembly of claim 9, wherein the contact section is coupled to the drive transmission member and has a range of motion in a direction between the contact section and the drive transmission member.

14. The assembly of claim 9, wherein the first support section has a stop and the second support section has a support surface.

15. The assembly of claim 14, wherein the stop and the support surface are located in a same plane.

16. An electric switch, comprising:

a spring having a base portion forming a proximal end of the spring, a contact section extending from the base portion to a distal end of the spring opposite the proximal end, the contact section having a contact member, and a return spring section extending from the base portion alongside the contact section, the base portion has a main portion and a flap connected to the main portion by a bent portion, the bent portion is bent 180° and the flap abuts the main portion;

a drive transmission member having a first support section and a second support section, the first support section engaged with the contact section and the return spring section resting against the second support section; and a drive system generating a driving force acting on the drive transmission member, the return spring section generating a return force acting on the drive transmission member and counteracting the driving force.

17. The electric switch of claim 16, wherein the return force is independent of a deflection of the contact section which occurs during operation of the electric switch.

18. The electric switch of claim 16, wherein the electric switch is a cradle relay.

* * * * *